US008892000B2

(12) United States Patent
Souda

(10) Patent No.: US 8,892,000 B2
(45) Date of Patent: Nov. 18, 2014

(54) IMAGE FORMING DEVICE CAPABLE OF EASILY DETACHING AND ATTACHING DEVELOPER CARTRIDGE RELATIVE TO MAIN CASING

(75) Inventor: Makoto Souda, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 90 days.

(21) Appl. No.: 13/492,096

(22) Filed: Jun. 8, 2012

(65) Prior Publication Data

US 2013/0028633 A1 Jan. 31, 2013

(30) Foreign Application Priority Data

Jul. 28, 2011 (JP) ..... 2011-165327

(51) Int. Cl.
*G03G 21/16* (2006.01)

(52) U.S. Cl.
CPC ..... *G03G 21/1623* (2013.01); *G03G 21/1647* (2013.01); *G03G 21/1671* (2013.01)
USPC ..... 399/110; 399/119; 399/115

(58) Field of Classification Search
CPC ..... G03G 21/1623; G03G 21/1647; G03G 21/1671; G03G 2221/1606; G03G 2221/1654; G03G 2221/18; G03G 2221/1815
USPC ..... 399/110, 115, 116, 119
See application file for complete search history.

(56) References Cited

U.S. PATENT DOCUMENTS 6,907,209 B2 * 6/2005 Abe ..... 399/107
6,989,849 B2 * 1/2006 Nomura et al. ..... 347/133
7,020,417 B2 * 3/2006 Nomura et al. ..... 399/111
7,215,905 B2 * 5/2007 Kamimura ..... 399/114
7,242,888 B2 * 7/2007 Ishii ..... 399/110
7,447,467 B2 * 11/2008 Kamimura et al. ..... 399/119
7,463,847 B2 * 12/2008 Sato ..... 399/119
7,720,411 B2 5/2010 Itabashi
7,720,413 B2 * 5/2010 Kamimura et al. ..... 399/119
7,729,637 B2 6/2010 Sato
8,064,793 B2 * 11/2011 Kamimura et al. ..... 399/110
8,107,855 B2 * 1/2012 Nishimura et al. ..... 399/112
8,265,522 B2 * 9/2012 Kamimura et al. ..... 399/110

(Continued)

FOREIGN PATENT DOCUMENTS

JP 2004-240198 8/2004
JP 2004-279937 10/2004

(Continued)

*Primary Examiner* — David Gray
*Assistant Examiner* — Carla Therrien
(74) *Attorney, Agent, or Firm* — Banner & Witcoff, Ltd.

(57) ABSTRACT

An image forming device includes a permitting unit and a moving unit. The permitting unit selectively establishes a first positional relationship in which photosensitive members contact an endless belt and a second positional relationship in which the photosensitive members separate from the endless belt. The moving unit moves a charger between a first position confronting the corresponding photosensitive member at a rear side thereof in a juxtaposed direction and a second position moved away from the first position. The endless belt confronts the photosensitive members at a top side thereof in an orthogonal direction. Each developer cartridge confronts the corresponding photosensitive member at a bottom side thereof. The developer cartridge is attachable to and detachable from a main casing while moved past a front side of the corresponding photosensitive member when the second positional relationship is established and the neighboring charger is in the second position.

21 Claims, 6 Drawing Sheets

(56) References Cited

U.S. PATENT DOCUMENTS

| | | | | |
|---|---|---|---|---|
| 8,457,520 | B2 * | 6/2013 | Kamimura et al. | 399/110 |
| 8,463,159 | B2 * | 6/2013 | Nakagami et al. | 399/115 |
| 8,554,110 | B2 * | 10/2013 | Mushika et al. | 399/119 |
| 8,559,850 | B2 * | 10/2013 | Ishikawa et al. | 399/116 |
| 8,761,633 | B2 * | 6/2014 | Souda | 399/111 |
| 2004/0161260 | A1 | 8/2004 | Sato | |
| 2004/0165910 | A1 | 8/2004 | Sato et al. | |
| 2008/0219696 | A1 | 9/2008 | Itabashi | |
| 2009/0142092 | A1 | 6/2009 | Sato | |
| 2009/0311005 | A1 * | 12/2009 | Nakagami et al. | 399/115 |
| 2009/0317130 | A1 * | 12/2009 | Ishikawa et al. | 399/116 |
| 2010/0074649 | A1 | 3/2010 | Kondo | |
| 2011/0064460 | A1 * | 3/2011 | Watanabe et al. | 399/115 |
| 2012/0237256 | A1 | 9/2012 | Souda | |

FOREIGN PATENT DOCUMENTS

| | | |
|---|---|---|
| JP | 2008-224837 | 9/2008 |
| JP | 2009-157135 | 7/2009 |
| JP | 2010-072587 | 4/2010 |

* cited by examiner

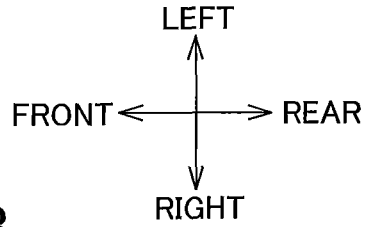
FIG.3A
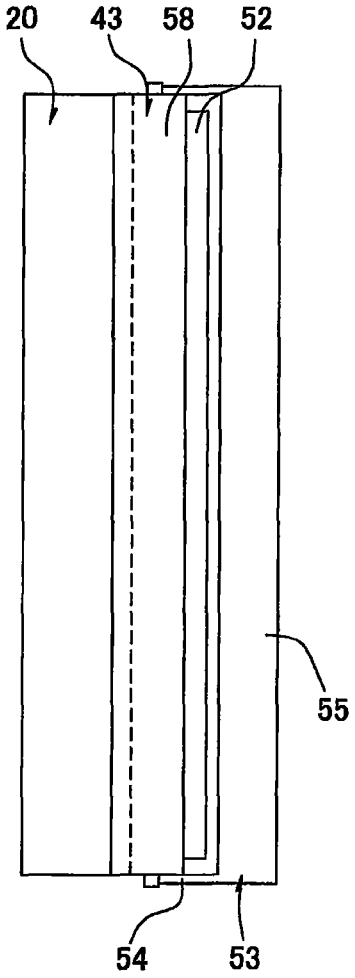
FIG.3B
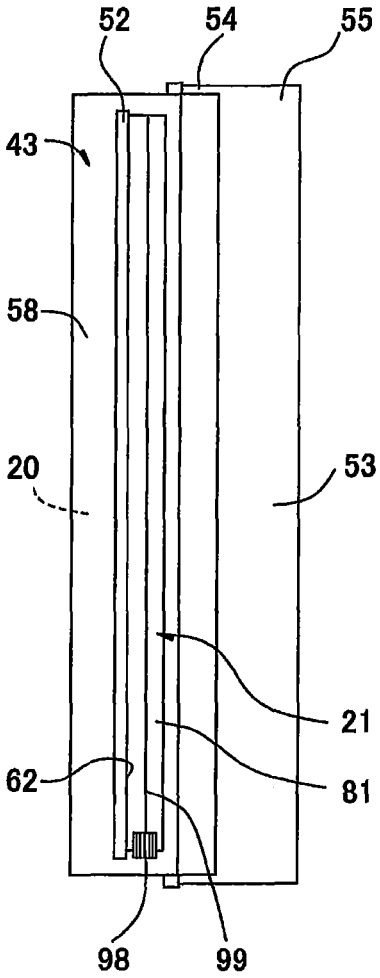

IMAGE FORMING DEVICE CAPABLE OF EASILY DETACHING AND ATTACHING DEVELOPER CARTRIDGE RELATIVE TO MAIN CASING

CROSS REFERENCE TO RELATED APPLICATION

This application claims priority from Japanese Patent Application No. 2011-165327 filed Jul. 28, 2011. The entire content of the priority application is incorporated herein by reference.

TECHNICAL FIELD

The present invention relates to an electro-photographic type image forming device.

BACKGROUND

Known is an electro-photographic type color printer provided with four photosensitive drums for colors of yellow, magenta, cyan, and black. Japanese Patent Application Publication No. 2009-157135 discloses such conventional color multi-function device including process cartridges for respective colors arrayed in a horizontal direction, a support frame supporting the process cartridges and can be pulled frontward from a main casing, an intermediate transfer belt, and a secondary transfer roller. Each process cartridge includes a photosensitive drum and a developing unit that includes a developing roller, a first supply roller, a second supply roller, a toner layer thickness regulation blade, and a toner container. The intermediate transfer belt extends in the horizontal direction and is positioned above and in contact with the respective photosensitive drums. The secondary transfer roller is in contact with a longitudinal end portion of the intermediate transfer belt.

Each process cartridge can be detached from and attached to the support frame in a state where the support frame is pulled out frontward from the main casing.

SUMMARY

In the above-described color multi-function device, the photosensitive drum and the developing unit are provided integrally in each process cartridge. Here, exchange of the photosensitive drum is less frequent than re-filling of the toner. Therefore, only exchange of the developing unit is required without exchange of the photosensitive drum.

However, according to the above-described color multi-function device, the photosensitive drum is supported to an upper end portion of the process cartridge, whereas the developing unit is positioned below the photosensitive drum. Accordingly, attachment and detachment of the developing unit only with respect to the support frame in a vertical direction may be difficult to achieve.

In view of the foregoing, it is an object of the present invention to provide an image forming device having a configuration such that an endless belt confronts photosensitive members at one side thereof in an orthogonal direction and developer cartridges respectively confront the photosensitive members at another side thereof opposite to the one side in the orthogonal direction, and capable of easily detaching each developer cartridge from a main casing in a direction from the another side to the one side and attaching each developer cartridge to the main casing in a direction from the one side to the another side.

In order to attain the above and other objects, the present invention provides an image forming device including: a main casing; a plurality of photosensitive members; a plurality of chargers; an endless belt; a plurality of developer cartridges; a permitting unit; and a moving unit. The plurality of photosensitive members is disposed inside the main casing and juxtaposed with each other in a juxtaposed direction with a space between neighboring photosensitive members. Each of the plurality of photosensitive members is configured to carry a developing agent image thereon. The plurality of chargers is in one-to-one correspondence with the plurality of photosensitive members and configured to charge the corresponding photosensitive members. Each of the plurality of chargers is movable between a first position in which the charger is in confrontation with the corresponding photosensitive member at a first side thereof in the juxtaposed direction to charge the corresponding photosensitive member and a second position in which the charger is moved away from the first position. The endless belt is stretched in the juxtaposed direction and having a surface in direct confrontation with the plurality of photosensitive members at a second side thereof in an orthogonal direction generally orthogonal to the juxtaposed direction. The plurality of developer cartridges is in one-to-one correspondence with the plurality of photosensitive members. Each of the plurality of developer cartridges is configured to be detachably mounted in the main casing and has a portion disposed in confrontation with the corresponding photosensitive member at a third side thereof opposite to the second side in the orthogonal direction. Each of the plurality of developer cartridges has a developing agent bearing member on which a developing agent to be supplied to the corresponding photosensitive member is carried. The permitting unit is configured to allow the plurality of photosensitive members and the endless belt to selectively establish a first relative positional relationship in which the plurality of photosensitive members and the endless belt are in contact with each other and a second relative positional relationship in which the plurality of photosensitive members and the endless belt are spaced apart from each other to permit each of the plurality of developer cartridges to be detached from or attached to the main casing. The moving unit is configured to move the charger between the first position and the second position. A direction from the second side to the third side is an attachment direction of the developer cartridge into the main casing and a direction from the third side to the second side is a detachment direction of the developer cartridge from the main casing. Each of the plurality of photosensitive members has a fourth side opposite to the first side in the juxtaposed direction, and among the plurality of the photosensitive members and the plurality of the chargers, a first photosensitive member and a corresponding first charger comprise a first set, and a second photosensitive member and a corresponding second charger comprise a second set. The first set and the second set are arrayed with each other in the juxtaposed direction. The developer cartridge for the second set is configured to be attached to and detached from the main casing while moved past the fourth side of the corresponding photosensitive member of the second set when the permitting unit establishes the second relative positional relationship and when the moving unit moves the charger of the first set to the second position.

BRIEF DESCRIPTION OF THE DRAWINGS

The particular features and advantages of the invention as well as other objects will become apparent from the following description taken in connection with the accompanying drawings, in which:

FIG. 3A is an explanatory view illustrating detachment and attachment of the developer cartridges shown in FIG. 1, in which a drum unit is in a charging position as viewed from a top side of the process unit;

FIG. 3B is an explanatory view illustrating detachment and attachment of the developer cartridges shown in FIG. 1, in which the drum unit is in a retracted position as viewed from the top side of the process unit;

DETAILED DESCRIPTION

Figure 1:
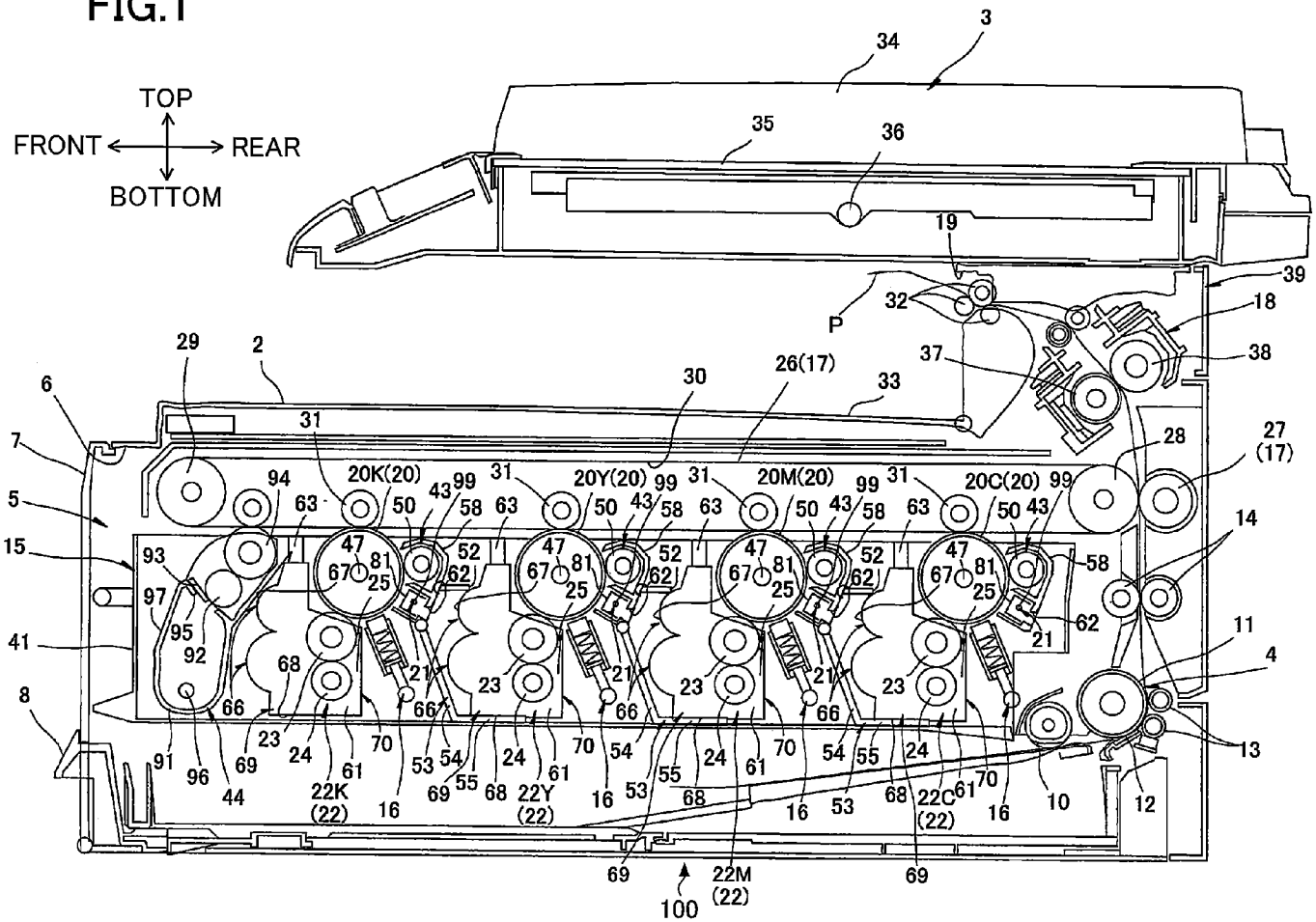
FIG. 1 is a cross-sectional view of a color printer as an image forming device according to a first embodiment of the present invention.

An image forming device according to a first embodiment of the present invention will be described while referring to FIGS. 1 through 3 wherein like parts and components are designated by the same reference numerals to avoid duplicating description.

1. Overall Structure of Color Printer

As shown in FIG. 1, the image forming device according to the first embodiment is a horizontal intermediate transfer type color printer 100.

The color printer 100 is a multifunction device that is integrally provided with a main casing 2 and a flatbed scanner 3 for reading image data from original documents. The flatbed scanner 3 is disposed above the main casing 2.

Within the main casing 2, the color printer 100 is further provided with a sheet supply unit 4 and an image forming unit 5. The sheet supply unit 4 is adapted to supply a sheet of paper P to the image forming unit 5. The image forming unit 5 is adapted to form images on the sheet of paper P supplied from the sheet supply unit 4.

(1) Main Casing

The main casing 2 has a box shape that is substantially rectangular in a side view. The sheet supply unit 4 and the image forming unit 5 are mounted in the main casing 2. The main casing 2 has one side wall in which an opening 6 is formed. A front cover 7 is provided on the side wall so as to be pivotally movable about a lower end thereof between a closed position (FIG. 1) for closing the opening 6 and an open position (FIG. 2) for opening the opening 6.

The terms "upward", "downward", "upper", "lower", "above", "below", "beneath", "right", "left", "front", "rear" and the like will be used throughout the description assuming that the color printer 100 is disposed in an orientation in which it is intended to be used. In the following description, the side of the color printer 100 on which the front cover 7 is provided (left side in FIG. 1) will be referred to as the front side of the color printer 100, and a side opposite to the side (right side in FIG. 1) will be referred to as the rear side of the color printer 100. Top, bottom, left, and right sides of the color printer 100 in the following description will be based on the reference point of a user viewing the color printer 100 from the front side.

(2) Sheet Supply Unit

The sheet supply unit 4 includes a sheet supply tray 8 for accommodating the sheets of paper P. The sheet supply tray 8 is disposed at a bottom portion of the main casing 2. The sheet supply tray 8 is detachably mounted in the main casing 2.

The sheet supply unit 4 includes a pickup roller 10, a sheet supply roller 11, a sheet supply pad 12, a pair of pinch rollers 13, and a pair of registration rollers 14.

The pickup roller 10 is disposed above a rear end portion of the sheet supply tray 8. The sheet supply roller 11 is disposed rearward of the pickup roller 10. The sheet supply pad 12 is disposed below and opposite the sheet supply roller 11. The pair of pinch rollers 13 opposes each other in a vertical direction. The pair of pinch rollers 13 is disposed rearward of the sheet supply roller 11 and contacts the sheet supply roller 11. The pair of registration rollers 14 opposes each other in a frontward/rearward direction and disposed above the sheet supply roller 11.

The sheets of paper P accommodated in the sheet supply tray 8 are conveyed between the sheet supply roller 11 and the sheet supply pad 12 in association with rotation of the pickup roller 10, and are separated sheet by sheet in association with rotation of the sheet supply roller 11. Then, in association with rotation of the sheet supply roller 11, the separated sheet P is conveyed toward the registration rollers 14 while passing between the sheet supply roller 11 and each pinch roller 13. In association with rotation of the registration rollers 14, the sheet P is conveyed to the image forming unit 5 (between an intermediate transfer belt 30 (described later) and a secondary transfer roller 27 (described later)) at a prescribed timing.

(3) Image Forming Unit

The image forming unit 5 is disposed above the sheet supply unit 4. The image forming unit 5 includes a process unit (permitting unit) 15, four LED units 16 corresponding to each color, a transfer unit 17, and a fixing unit 18.

(3-1) Process Unit

The process unit 15 is disposed above and opposite the sheet supply tray 8. The process unit 15 is also disposed frontward of the pickup roller 10. The process unit 15 is overlapped with the pickup roller 10 when projected in the frontward/rearward direction. The process unit 15 is slidably movable in the frontward/rearward direction between an accommodated position (FIG. 1) in which the process unit 15 is accommodated in the main casing 2 and a pulled-out position (FIG. 2) in which the process unit 15 is pulled outward from the main casing 2.

When the process unit 15 is in the accommodated position, the intermediate transfer belt 30 (described later) and each photosensitive drum 20 (described later) are in a first relative positional relationship in which the intermediate transfer belt 30 and each photosensitive drum 20 are arranged in contact with each other. When the process unit 15 is in the pulled-out position, the intermediate transfer belt 30 (described later) and each photosensitive drum 20 (described later) are in a second relative positional relationship in which the intermediate transfer belt 30 and each photosensitive drum 20 are arranged spaced apart from each other.

Further, the process unit 15 accommodates therein a plurality of photosensitive drums 20 (four in the embodiment) corresponding to each color, a plurality of Scorotron chargers 21 (four in the embodiment) corresponding to the plurality of photosensitive drums 20, and a plurality of developer cartridges 22 (four in the embodiment) corresponding to the plurality of photosensitive drums 20.

Each photosensitive drum 20 is cylindrical in shape extending in a rightward/leftward direction and has a drum shaft 47 oriented along the rightward/leftward direction.

The four photosensitive drums 20 are juxtaposed with and spaced apart from each other in the frontward/rearward direction. More specifically, the four photosensitive drums 20 include a black photosensitive drum 20K, a yellow photosensitive drum 20Y, a magenta photosensitive drum 20M, and a cyan photosensitive drum 20C arranged in this order from front to rear.

The Scorotron chargers 21 are disposed rearward of the respective photosensitive drums 20 and confront but do not contact the photosensitive drums 20. Each Scorotron charger 21 includes a metal charging wire 99 and a grid 81.

The charging wire 99 is stretched taut in the rightward/leftward direction. The charging wire 99 is configured to generate Corona discharge to apply a uniform charge of positive polarity to a surface of the photosensitive drum 20.

The grid 81 is positioned between the charging wire 99 and the photosensitive drum 20.

Each developer cartridge 22 is disposed downward and frontward of the corresponding photosensitive drum 20. More specifically, the developer cartridge 22 has a portion disposed downward of the corresponding photosensitive drum 20 and a portion disposed frontward of the corresponding photosensitive drum 20.

The four developer cartridges 22 are juxtaposed with and spaced apart from each other in the frontward/rearward direction. More specifically, the four developer cartridges 22 include a black developer cartridge 22K, a yellow developer cartridge 22Y, a magenta developer cartridge 22M, and a cyan developer cartridge 22C arranged in this order from front to rear.

Further, each developer cartridge 22 includes a cartridge frame 61 and a developing roller 23 supported to the cartridge frame 61.

Each cartridge frame 61 is formed in a generally box shape elongated in the rightward/leftward direction.

Each developing roller 23 is rotatably supported in an upper rear end of the cartridge frame 61. An upper edge of the developing roller 23 is exposed through an upper rear edge of the cartridge frame 61 and contacts the corresponding photosensitive drum 20 from the bottom thereof.

Each developer cartridge 22 also includes, within the cartridge frame 61, a supply roller 24 for supplying toner to the developing roller 23, and a thickness-regulating blade 25 for regulating the thickness of the toner supplied to the developing roller 23. The cartridge frame 61 accommodates toner as a developing agent for a corresponding color in a space formed in front of the supply roller 24.

(3-2) LED Unit

Each LED unit 16 is disposed rearward of the corresponding developer cartridge 22. The LED unit 16 is also disposed below and in confrontation with the corresponding photosensitive drum 20. The LED unit 16 is adapted to expose the surface of the corresponding photosensitive drum 20 to light based on prescribed image data.

(3-3) Transfer Unit

The transfer unit 17 includes a belt unit 26 and the secondary transfer roller 27.

The belt unit 26 is disposed above the process unit 15 and extends in the frontward/rearward direction so as to confront each photosensitive drum 20 from above.

The belt unit 26 includes a drive roller 28, a driven roller 29, the intermediate transfer belt 30, and four primary transfer rollers 31.

The drive roller 28 and the driven roller 29 are arranged in confrontation with and spaced apart from each other in the frontward/rearward direction.

The intermediate transfer belt 30 is formed of an endless belt. The intermediate transfer belt 30 is stretched around the drive roller 28 and the driven roller 29, with a lower portion of the intermediate transfer belt 30 contacting each of the photosensitive drums 20. The intermediate transfer belt 30 circulates in a direction so that the lower portion of the intermediate transfer belt 30 in contact with the photosensitive drums 20 moves rearward.

Each primary transfer roller 31 is disposed in confrontation with the corresponding photosensitive drum 20, with the lower portion of the intermediate transfer belt 30 interposed therebetween.

The secondary transfer roller 27 is disposed rearward of the belt unit 26. Further, the secondary transfer roller 27 confronts the drive roller 28 of the belt unit 26, interposing the intermediate transfer belt 30 therebetween.

(3-4) Fixing Unit

The fixing unit 18 is disposed above the secondary transfer roller 27. The fixing unit 18 includes a heating roller 37, and a pressure roller 38 in confrontation with the heating roller 37.

(3-5) Image Forming Operations (3-5-1) Developing Operation

The toner accommodated in the developer cartridge 22 is supplied to the supply roller 24, and then to the developing roller 23.

As the developing roller 23 rotates, the toner supplied to the developing roller 23 is positively tribo-charged between the supply roller 24 and the developing roller 23, and the thickness-regulating blade 25 regulates the toner carried on the surface of the developing roller 23 to a prescribed thickness, so that the developing roller 23 carries a uniform thin layer of toner thereon.

In the meantime, the Scorotron charger 21 applies a uniform charge of positive polarity to the surface of the corresponding photosensitive drum 20 while the photosensitive drum 20 rotates. Subsequently, the LED unit 16 exposes the surface of the corresponding photosensitive drum 20 to light. An electrostatic latent image corresponding to an image to be formed on the sheet of paper P is formed on the surface of the photosensitive drum 20.

As the photosensitive drum 20 continues to rotate, the positively charged toner carried on the surface of the developing roller 23 is supplied to the electrostatic latent image formed on the surface of the photosensitive drum 20, thereby developing the electrostatic latent image into a visible toner image through reverse development. Thus, the toner image is formed on the surface of the photosensitive drum 20.

(3-5-2) Transfer and Fixing Operations

The toner image formed on the surface of each photosensitive drum 20 through reverse development is primary-transferred onto the lower portion of the intermediate transfer belt 30 conveyed rearward from front, thereby forming a color image on the intermediate transfer belt 30.

The color image formed on the intermediate transfer belt 30 is secondary-transferred onto the sheet P supplied from the sheet supply unit 4 while the intermediate transfer belt 30 passes through a position where the intermediate transfer belt 30 confronts the secondary transfer roller 27.

The color image transferred onto the sheet P is thermally fixed to the sheet P by heat and pressure, as the sheet P passes between the heating roller 37 and the pressure roller 38 in the fixing unit 18.

(4) Discharge

A discharge tray 33 on which the sheet P is discharged is formed on a top surface of the main casing 2. Further, a discharge unit 39 is provided in an upper rear portion of the main casing 2. The discharge unit 39 protrudes upward of the discharge tray 33.

The discharge unit 39 includes a discharge outlet 19 positioned above the discharge tray 33 for discharging the sheet P onto the discharge tray 33. The discharge unit 39 also includes, within the discharge outlet 19, a plurality of discharge rollers 32 (three in the embodiment) for conveying the sheet P toward the discharge tray 33.

After the color image has been fixed to the sheet P in the fixing unit 18, the sheet P is discharged by the discharge rollers 32 onto the discharge tray 33.

(5) Flatbed Scanner

The flatbed scanner 3 is disposed above and spaced apart from the discharge tray 33, and supported to an upper end portion of the discharge unit 39. The flatbed scanner 3 includes a restraining cover 34, a glass plate 35, and a CCD sensor 36. After an original document is placed between the restraining cover 34 and the glass plate 35, the CCD sensor 36 is slidingly moved to read image data from the original document.

2. Details of Process Unit

The process unit 15 includes a process frame 41, as shown in FIG. 1.

The process frame 41 is formed in a generally rectangular box shape with an open top. The process frame 41 supports a plurality of drum units 43 (four in the embodiment), the plurality of developer cartridges 22, a belt cleaning unit 44, and the plurality of LED units 16.

(1) Drum Unit

Each drum unit 43 includes the photosensitive drum 20, the Scorotron charger 21, a drum cleaning roller 50, and a unit frame 58.

The photosensitive drum 20 is rotatably supported to the process frame 41. More specifically, right and left end portions of the drum shaft 47 of the photosensitive drum 20 are respectively supported to right and left side walls of the process frame 41.

The Scorotron charger 21 is disposed rearward of the corresponding photosensitive drum 20 and confronts the photosensitive drum 20, as described above.

The drum cleaning roller 50 is disposed rearward of the corresponding photosensitive drum 20, and confronts and contacts the surface of the photosensitive drum 20. The drum cleaning roller 50 is adapted to collect residual toner remaining on the surface of the photosensitive drum 20 after the toner image has been transferred onto the intermediate transfer belt 30.

The unit frame 58 is formed in a generally box shape elongated in the rightward/leftward direction with a front opening in confrontation with the corresponding photosensitive drum 20. The unit frame 58 has a lower portion in which the Scorotron charger 21 is supported, and an upper portion in which the drum cleaning roller 50 is supported.

The unit frame 58 has a lower rear portion formed with an opening 62. The opening 62 allows the charging wire 99 of the Scorotron charger 21 to be exposed therethrough. Further, the unit frame 58 includes a cleaning member 98 (FIG. 3B).

The opening 62 is rectangular-shaped and elongated in the rightward/leftward direction (FIG. 3B).

The cleaning member 98 pinches the charging wire 99 within the opening 62. The cleaning member 98 is slidably movable in the rightward/leftward direction in which the charging wire 99 extends (FIG. 3B). The cleaning member 98 slidingly moves along the charging wire 99 to clean the charging wire 99. The cleaning member 98 is exposed at a top side of the photosensitive drum 20 when the drum unit 43 is moved to a retracted position (described later) (FIG. 3B).

Each of the unit frame 58 corresponding to the black photosensitive drum 20K, the unit frame 58 corresponding to the yellow photosensitive drum 20Y, and the unit frame 58 corresponding to the magenta photosensitive drum 20M supports a first assisting member 52 and a second assisting member 53 as a moving unit. With respect to the unit frame 58 corresponding to the cyan photosensitive drum 20C, the first assisting member 52 and the second assisting member 53 are not provided.

The first assisting member 52 is a projection projecting rearward from a rear edge of the unit frame 58 when the drum unit 43 is in a charging position (described later) (FIG. 3A). The first assisting member 52 is elongated in the rightward/leftward direction.

The second assisting member 53 is disposed below the drum unit 43. The second assisting member 53 is supported to a lower edge of the unit frame 58 and pivotally movable relative to the unit frame 58. More specifically, the second assisting member 53 includes an arm portion 54 and a contact plate 55. The contact plate 55 is formed in a generally flat plate shape elongated in the frontward/rearward direction and in the rightward/leftward direction. The arm portion 54 has right and left arms, each formed in a generally lever shape and extending in the generally vertical direction. The right and left arms have upper ends supported to pivot shafts provided at right and left ends of the lower edge of the unit frame 58, respectively, and are pivotally movable about the pivot shafts relative to the unit frame 58. The right and left arms also have lower ends connected to right and left edges of a front portion of the contact plate 55, respectively.

The unit frame 58 has right and left end portions that are respectively supported to right and left ends of the drum shaft 47 of the corresponding photosensitive drum 20, and is pivotally movable relative to the photosensitive drum 20.

Figure 2:
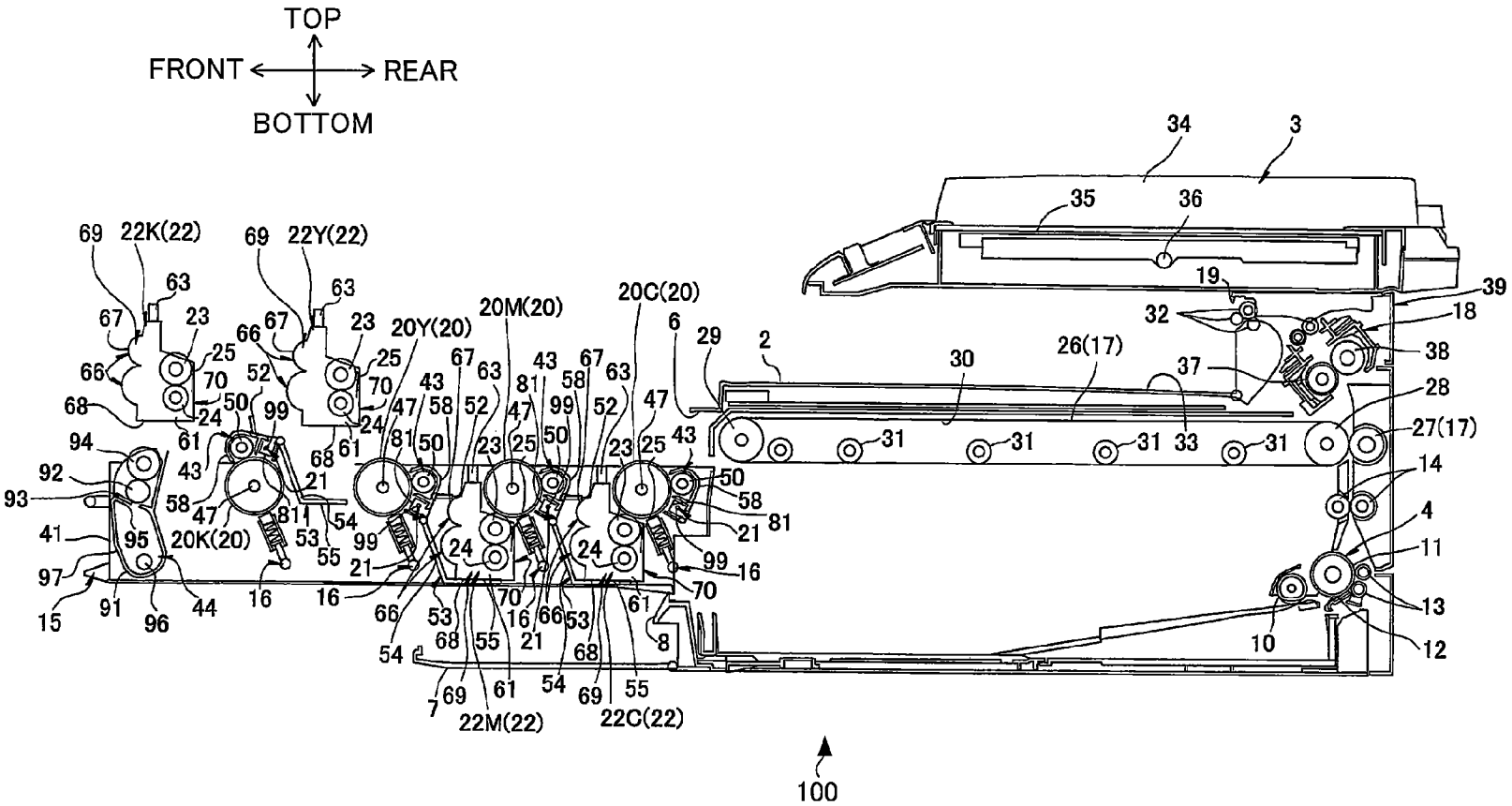
FIG. 2 is an explanatory view illustrating detachment and attachment of developer cartridges shown in FIG. 1, in which a process unit is pulled outward from a main casing.

Hence, as shown in FIGS. 2, 3A, and 3B, the unit frame 58 is pivotally movable about the drum shaft 47 between the charging position in which the Scorotron charger 21 is positioned in confrontation with and rearward of the corresponding photosensitive drum 20 to charge the photosensitive drum 20 and the retracted position in which the Scorotron charger 21 is retracted so as to be positioned above the corresponding photosensitive drum 20. Incidentally, the unit frame 58 corresponding to the cyan photosensitive drum 20C is not required to pivotally move between the charging position and the retracted position.

With respect to the charging position, see the drum units 43 corresponding to the yellow photosensitive drum 20Y, the magenta photosensitive drum 20M, and the cyan photosensitive drum 20C shown in FIG. 2. With respect to the retracted position, see the drum unit 43 corresponding to the black photosensitive drum 20K shown in FIG. 2.

When the unit frame 58 is in the charging position, the second assisting member 53 is positioned so that the contact plate 55 is in contact with a bottom plate of the process unit 15. See the second assisting members 53 corresponding to the yellow photosensitive drum 20Y and the magenta photosensitive drum 20M shown in FIG. 2.

When the unit frame 58 is in the retracted position, the second assisting member 53 is positioned in back of the corresponding photosensitive drum 20 and in front of the neighboring photosensitive drum 20 disposed immediate rearward of the corresponding photosensitive drum 20 so that the contact plate 55 is exposed through a space formed between the corresponding photosensitive drum 20 and the neighboring photosensitive drum 20. See the second assisting member 53 corresponding to the black photosensitive drum 20K shown in FIG. 2.

(2) Developer Cartridge

As shown in FIG. 1, each cartridge frame 61 includes a toner accommodating portion 69 for accommodating toner therein and a developing portion 70 for supporting the developing roller 23.

The toner accommodating portion 69 constitutes a front portion of the cartridge frame 61. The toner accommodating portion 69 has a top portion provided with a handle 63. The toner accommodating portion 69 has a front wall 67 provided with a protruding portion 66 including upper and lower protrusions. Each of the upper and lower protrusions of the protruding portion 66 is formed so as to protrude frontward from the front wall 67 and has a generally semicircular arc shape in cross-section.

The handle 63 protrudes upward from the top portion of the cartridge frame 61 at a substantially center portion thereof in the rightward/leftward direction.

The developing portion 70 constitutes a rear portion of the cartridge frame 61. As described above, the developing portion 70 supports the developing roller 23, the supply roller 24, and the thickness-regulating blade 25.

The developer cartridge 22 has a front-to-rear length greater than a front-to-rear distance defined between the unit frame 58 in the charging position and the photosensitive drums 20 disposed immediately rearward of the unit frame 58.

When the drum unit 43 is in the charging position, the developer cartridge 22 is mounted in the process unit 15 such that the upper protrusion of the protruding portion 66 of the toner accommodating portion 69 is disposed below and in confrontation with the first assisting member 52. At this time, a bottom wall 68 is in contact with and in confrontation with the contact plate 55 from above.

(3) Belt Cleaning Unit

As shown in FIGS. 1 and 2, the belt cleaning unit 44 is disposed in front of and in confrontation with the forefront developer cartridge 22, that is, the black developer cartridge 22K. The belt cleaning unit 44 is positioned close to the black developer cartridge 22K. The belt cleaning unit 44 includes a cleaning casing 97, and, within the cleaning casing 97, a waste toner accommodating portion 91, a relay roller 92, a scraping blade 93, and a belt cleaning roller 94 are provided.

The waste toner accommodating portion 91 is defined in the cleaning casing 97 to form a generally box shape having an open top. That is, an opening 95 is formed in a top portion of the waste toner accommodating portion 91.

The relay roller 92 is disposed above and in confrontation with the opening 95 of the waste toner accommodating portion 91.

The scraping blade 93 is formed in a generally flat plate shape extending in the frontward/rearward direction. The scraping blade 93 has a rear end (free end) with which a bottom edge of the relay roller 92 is in contact, and a front end (base end) fixed to the waste toner accommodating portion 91 at a front periphery of the opening 95.

The belt cleaning roller 94 is rotatably supported to an upper portion of the cleaning casing 97 and contacts the relay roller 92 from above.

The cleaning casing 97 is formed in a generally box-shape with an open top.

The cleaning casing 97 rotatably supports the belt cleaning roller 94, exposing the top edge of the belt cleaning roller 94 through the open top. Further, the cleaning casing 97 rotatably supports the relay roller 92 at a position below the belt cleaning roller 94.

The cleaning casing 97 has a pivot shaft 96 at a lower portion thereof. The pivot shaft 96 is supported to the process frame 41. The cleaning casing 97 is pivotally movable about the pivot shaft 96 relative to the process frame 41.

The belt cleaning unit 44 is disposed such that the top edge of the belt cleaning roller 94 contacts the lower portion of the intermediate transfer belt 30.

The belt cleaning unit 44 is pivotally movable about the pivot shaft 96 between an approaching position (FIG. 1) and a remote position (FIG. 2). In the approaching position, the belt cleaning unit 44 approaches the black photosensitive drum 20K from a front side thereof. In the remote position, the belt cleaning unit 44 is retracted forward from the black photosensitive drum 20K and remote from the black photosensitive drum 20K. The belt cleaning unit 44 is normally in the approaching position, and is movable to the remote position from the approaching position when the process unit 15 is pulled outward from the main casing 2 to be positioned in the pulled-out position.

The belt cleaning unit 44 is adapted to clean residual toner remaining on the surface of the intermediate transfer belt 30 by the belt cleaning roller 94 when the belt cleaning unit 44 is in the approaching position. The toner captured by the belt cleaning roller 94 is temporarily carried on the relay roller 92. Subsequently, the toner is scraped off from the relay roller 92 by the scraping blade 93. As a result, the toner is accommodated in the waste toner accommodating portion 91.

At this time, the upper rear portion of the belt cleaning unit 44 is disposed frontward of and in confrontation with the black photosensitive drum 20K such that a front-to-rear distance defined between the upper rear portion of the belt cleaning unit 44 and the black photosensitive drum 20K is smaller than the front-to-rear length of the developer cartridge 22 (FIG. 1).

When the belt cleaning unit 44 is in the remote position, the upper rear portion of the belt cleaning unit 44 is disposed frontward of and in confrontation with the black photosensitive drum 20K such that the front-to-rear distance defined between the upper rear portion of the belt cleaning unit 44 and the black photosensitive drum 20K is greater than the front-to-rear length of the developer cartridge 22 (FIG. 2).

3. Detachment and Attachment of Developer Cartridge

To detach each developer cartridge 22 from the process unit 15 or to attach each developer cartridge 22 to the process unit 15, a user initially opens the front cover 7 to pull the process unit 15 frontward and positions the process unit 15 in the pulled-out position, as shown in FIG. 2.

Here, for illustrative purposes, among the color developer cartridges 22 (the yellow developer cartridge 22Y, the magenta developer cartridge 22M, and the cyan developer cartridge 22C), detachment and attachment of the yellow developer cartridge 22Y relative to the process unit 15 will be described below.

To detach the yellow developer cartridge 22Y from the process unit 15, the user holds the handle 63 of the yellow developer cartridge 22Y to pull the yellow developer cartridge 22Y upward from the process frame 41.

As the yellow developer cartridge 22Y moves upward, the upper protrusion of the protruding portion 66 of the yellow developer cartridge 22Y pushes the first assisting member 52 of the drum unit 43 corresponding to the black photosensitive drum 20K diagonally upward and frontward from below. That is, the protruding portion 66 serves as a contacting portion and a first contacting portion.

Then, the unit frame 58 corresponding to the black photosensitive drum 20K is pivotally moved about the drum shaft 47 of the black photosensitive drum 20K in a counterclockwise direction in FIG. 2.

As the user pulls the yellow developer cartridge 22Y further upward, the lower protrusion of the protruding portion 66 of the yellow developer cartridge 22Y pushes the first assisting member 52 corresponding to the black photosensitive drum 20K, and the unit frame 58 corresponding to the black photosensitive drum 20K is pivotally moved further in the counterclockwise direction in FIG. 2. Hence, the unit frame 58 corresponding to the black photosensitive drum 20K is moved from the charging position between the black photosensitive drum 20K and the yellow photosensitive drum 20Y toward the retracted position above the black photosensitive drum 20K. The unit frame 58 is thus positioned at the retracted position.

As a result, an open space is formed between the black photosensitive drum 20K and the yellow photosensitive drum 20Y in the vertical direction. That is, the first assisting member 52 serves as a moving unit (interlocking unit) for moving the drum unit 43 to the retracted position in interlocking relation to the detaching movement of the developer cartridge 22 relative to the process unit 15.

As the user pulls the yellow developer cartridge 22Y further upward, the yellow developer cartridge 22Y passes through the open space between the yellow photosensitive drum 20Y and the black photosensitive drum 20K to be moved upward. That is, the yellow developer cartridge 22Y is moved upward while moved past a front side of the yellow photosensitive drum 20Y. Then, the yellow developer cartridge 22Y is detached from the process unit 15.

Hence, the detachment of the yellow developer cartridge 22Y from the process unit 15 is completed.

To attach the yellow developer cartridge 22Y to the process unit 15, the user initially holds the handle 63 of the yellow developer cartridge 22Y such that the developing roller 23 is positioned at a rear side of the handle 63 and the upper edge of the developing roller 23 is exposed through the upper rear edge of the yellow developer cartridge 22Y, and sets the yellow developer cartridge 22Y at a position above the process frame 41 between the black photosensitive drum 20K and the yellow photosensitive drum 20Y.

Then, the user moves the yellow developer cartridge 22Y downward into the process frame 41 to bring the yellow developer cartridge 22Y into abutment with the contact plate 55 of the second assisting member 53 corresponding to the black photosensitive drum 20K.

The bottom wall 68 of the yellow developer cartridge 22Y is brought into abutment with the contact plate 55 from above. That is, the bottom wall 68 of the yellow developer cartridge 22Y serves as a contacting portion and a second contacting portion.

As the user moves the yellow developer cartridge 22Y further downward into the process frame 41, the contact plate 55 is pressed downward by the bottom wall 68. Thus, the second assisting member 53 is moved downward.

As a result, the downward movement of the second assisting member 53 pivotally moves the unit frame 58 about the drum shaft 47 of the black photosensitive drum 20K in a clockwise direction in FIG. 2. Accordingly, the unit frame 58 is moved rearward and downward.

When the user moves the yellow developer cartridge 22Y downward into the process frame 41 until the contact plate 55 contacts the bottom plate of the process unit 15, the Scorotron charger 21 corresponding to the black photosensitive drum 20K is brought into the charging position where the Scorotron charger 21 is disposed rearward of and in confrontation with the black photosensitive drum 20K.

That is, the second assisting member 53 serves as a moving unit (interlocking unit) for moving the drum unit 43 to the charging position in interlocking relation to the attaching movement of the developer cartridge 22 relative to the process unit 15.

Hence, the attachment of the yellow developer cartridge 22Y to the process unit 15 is completed.

To detach the black developer cartridge 22K from the process unit 15, the user holds the handle 63 of the black developer cartridge 22K to pull the black developer cartridge 22K upward from the process frame 41.

As the black developer cartridge 22K moves upward, the upper protrusion of the protruding portion 66 of the black developer cartridge 22K pushes the upper rear portion of the cleaning casing 97 of the belt cleaning unit 44 from rear.

As a result, the belt cleaning unit 44 is pivotally moved about the pivot shaft 96 in the counterclockwise direction in FIG. 2, as described above. Hence, the upper rear portion of the belt cleaning unit 44 is moved frontward to be separated from the black photosensitive drum 20K, and the belt cleaning unit 44 is positioned at the remote position.

Because the belt cleaning unit 44 is in the remote position, the upper rear portion of the belt cleaning unit 44 confronts the black photosensitive drum 20K with the front-to-rear distance therebetween greater than the front-to-rear length of the developer cartridge 22.

The black developer cartridge 22K is moved further upward, passing through the open space formed between the belt cleaning unit 44 and the black photosensitive drum 20K. That is, the black developer cartridge 22K is moved upward while moved past a position in front of the black photosensitive drum 20K. Then, the black developer cartridge 22K is detached from the process unit 15.

Hence, the detachment of the black developer cartridge 22K from the process unit 15 is completed.

To attach the black developer cartridge 22K to the process unit 15, the user initially holds the handle 63 of the black developer cartridge 22K such that the developing roller 23 is positioned at a rear side of the handle 63 and the upper edge of the developing roller 23 is exposed through the upper rear edge of the black developer cartridge 22K, and sets the black developer cartridge 22K at a position above the process frame 41 between the belt cleaning unit 44 and the black photosensitive drum 20K.

Then, the user moves the black developer cartridge 22K downward into the process frame 41.

When the bottom wall 68 of the black developer cartridge 22K is brought into contact with the bottom plate of the process unit 15, the attachment of the black developer cartridge 22K to the process unit 15 is completed.

Then the user pushes the upper portion of the cleaning casing 97 rearward to pivotally move the belt cleaning unit 44 about the pivot shaft 96 in the clockwise direction in FIG. 2. Accordingly, the belt cleaning unit 44 is moved back to the approaching position.

Then, the user pushes the process unit 15 rearward to accommodate the process unit 15 into the main casing 2. The process unit 15 is thus positioned at the accommodated position. Thereafter, the user closes the front cover 7, as shown in FIG. 1.

4. Operations and Effects (1) In the color printer 100 according to the first embodiment of the present invention, as shown in FIG. 2, the drum unit 43 corresponding to the black photosensitive drum 20K disposed immediately frontward of the yellow photosensitive drum 20Y, for example, is moved to the retracted position, so that the open space can be formed in front of the yellow photosensitive drum 20Y and in the vertical direction. Further, the yellow developer cartridge 22Y can be detached from and attached to the process unit 15, passing through the open space in front of the yellow photosensitive drum 20Y in the vertical direction. That is, the developer cartridge 22 can be moved past the front side of the corresponding photosensitive drum 20.

Therefore, in such a configuration that the belt unit 26 is disposed above and in confrontation with the photosensitive drums 20, and each photosensitive drum 20 is disposed above and in confrontation with the corresponding developer cartridge 22, each developer cartridge 22 can be easily detached from and attached to the main casing 2 (process unit 15) from above.

(2) In the color printer 100 according to the first embodiment of the present invention, as shown in FIG. 2, when the yellow developer cartridge 22Y, for example, is detached from the process unit 15, the protruding portion 66 of the developer cartridge 22 is brought into contact with the first assisting member 52 of the drum unit 43 corresponding to the black photosensitive drum 20K, so that the drum unit 43 can be reliably moved to the retracted position where the Scorotron charger 21 is positioned above the corresponding photosensitive drum 20. Further, when the yellow developer cartridge 22Y, for example, is attached to the process unit 15, the bottom wall 68 of the yellow developer cartridge 22Y is brought into abutment with the second assisting member 53 (contact plate 55) of the drum unit 43 corresponding to the black photosensitive drum 20K, so that the drum unit 43 can be reliably moved back to the charging position where the Scorotron charger 21 confronts the corresponding photosensitive drum 20.

(3) In the color printer 100 according to the first embodiment of the present invention, as shown in FIG. 2, when the drum unit 43 is in the charging position where the Scorotron charger 21 is disposed in confrontation with and rearward of the photosensitive drum 20, the first assisting member 52 of the drum units 43 is positioned above the protruding portion 66 of the developer cartridge 22 within a detachment and attachment path of the developer cartridge 22. Hence, when the developer cartridge 22 is detached from the main casing 2, the first assisting member 52 corresponding to the photosensitive drum 20 disposed immediately frontward of the detaching developer cartridge 22 can be reliably brought into contact with the protruding portion 66 of the detaching developer cartridge 22.

Therefore, in association with the detaching movement of the developer cartridge 22, the Scorotron charger 21 corresponding to the photosensitive drum 20 disposed immediately frontward of the detaching developer cartridge 22 can be reliably moved away from the rear side of the photosensitive drum 20.

Further, provided that the second assisting member 53 of the drum units 43 in the retracted position where the Scorotron charger 21 is retracted from the rear side of the photosensitive drum 20 is positioned within the detachment and attachment path of the developer cartridge 22, the bottom wall 68 of the developer cartridge 22 can be reliably brought into abutment with the second assisting member 53 (contact plate 55) of the drum unit 43 when the developer cartridge 22 is attached to the main casing 2 (process unit 15).

Therefore, in association with the attaching movement of the developer cartridge 22, the Scorotron charger 21 corresponding to the photosensitive drum 20 disposed immediately frontward of the attaching developer cartridge 22 can be reliably moved back to the charging position where the Scorotron charger 21 is in confrontation with and rearward of the photosensitive drum 20.

As a result, smooth detachment and attachment of the developer cartridge 22 relative to the main casing 2 can be realized.

(4) In the color printer 100 according to the first embodiment of the present invention, as shown in FIGS. 2 and 3, when the Scorotron charger 21 is in the retracted position, the photosensitive drum 20 corresponding to the retracted Scorotron charger 21 can be covered by the retracted Scorotron charger 21 from above.

Since the photosensitive drum 20 is covered by the retracted Scorotron charger 21 from above, the retracted Scorotron charger 21 can protect the photosensitive drum 20 from contact with the developer cartridge 22 when the developer cartridge 22 is attached to the main casing 2.

(5) In the color printer 100 according to the first embodiment of the present invention, as shown in FIG. 3B, the cleaning member 98 is disposed at a top side of the photosensitive drum 20 when the Scorotron charger 21 is moved to the retracted position where the Scorotron charger 21 is positioned above the corresponding photosensitive drum 20. Hence, the user can easily access the cleaning member 98, thereby easily cleaning the charging wire 99 of the Scorotron charger 21.

(6) In the color printer 100 according to the first embodiment of the present invention, as shown in FIG. 1, compared to a case where a scanner unit irradiates laser beams toward photosensitive drums, the LED unit 16 which is smaller in size than the scanner unit exposes the corresponding photosensitive drum 20 to light.

Accordingly, a compact color printer 100 can be realized.

(7) In the color printer 100 according to the first embodiment of the present invention, as shown in FIG. 1, the toner images can be transferred onto the sheet P without passing the sheet P between the photosensitive drums 20 and the belt unit 26, compared with a direct tandem type printer in which a toner image is directly transferred onto a sheet.

Accordingly, the conveying path of the sheet P can be simplified.

(8) In the color printer 100 according to the first embodiment of the present invention, as shown in FIG. 1, the intermediate transfer belt 30 can be cleaned by the belt cleaning unit 44.

Further, as shown in FIG. 2, the belt cleaning unit 44 can be moved to the remote position, and accordingly, an open space can be secured in front of the forefront black photosensitive drum 20K in the vertical direction.

With this configuration, the foremost black developer cartridge 22K can be detached from or attached to the main casing 2, while moved past the front side of the black photosensitive drum 20K (open space defined in the vertical direction).

As a result, the black developer cartridge 22K can be easily detached from and attached to the main casing 2 (process unit 15) from above.

Further, the detachment and attachment path of the black developer cartridge 22K is secured by positioning the belt cleaning unit 44 in the remote position. Therefore, without positioning the belt cleaning unit 44 spaced apart from the black photosensitive drum 20K at the front side of the black photosensitive drum 20K, the belt cleaning unit 44 can be positioned close to the black photosensitive drum 20K at the front side of the black photosensitive drum 20K.

Consequently, the belt cleaning unit 44 can be disposed in front of the black photosensitive drum 20K in a space-efficient manner. Thus, the color printer 100 can be downsized in the frontward/rearward direction.

(9) In the color printer 100 according to the first embodiment of the present invention, as shown in FIG. 2, the process unit 15 is pulled frontward from the main casing 2 to detach and attach each developer cartridge 22 relative to the process unit 15. Hence, front accessibility of the color printer 100 can be realized.

5. Second Embodiment

A color printer 200 as an image forming device according to a second embodiment of the present invention will be described while referring to FIGS. 4 and 5.

In the following description, parts and components appearing in the second embodiment and the same as those in the first embodiment will be designated by the same reference numerals as those in the first embodiment to avoid duplicating description, and only parts and components differing from those of the first embodiment will be described.

In the above-described first embodiment, the handle 63 protrudes from the top portion of the cartridge frame 61 at the substantially right-to-left center portion thereof.

In the second embodiment, a handle 263 is provided at a top portion of a cartridge frame 261 of a developer cartridge 222, and retractable and protrudable in the vertical direction. Whereas the handle 263 is retracted in the cartridge frame 261 when the process unit 15 is in the accommodated position, as shown in FIG. 4, the handle 263 protrudes from the cartridge frame 261 when the process unit 15 is in the pulled-out position, as shown in FIG. 5.

Figure 4:
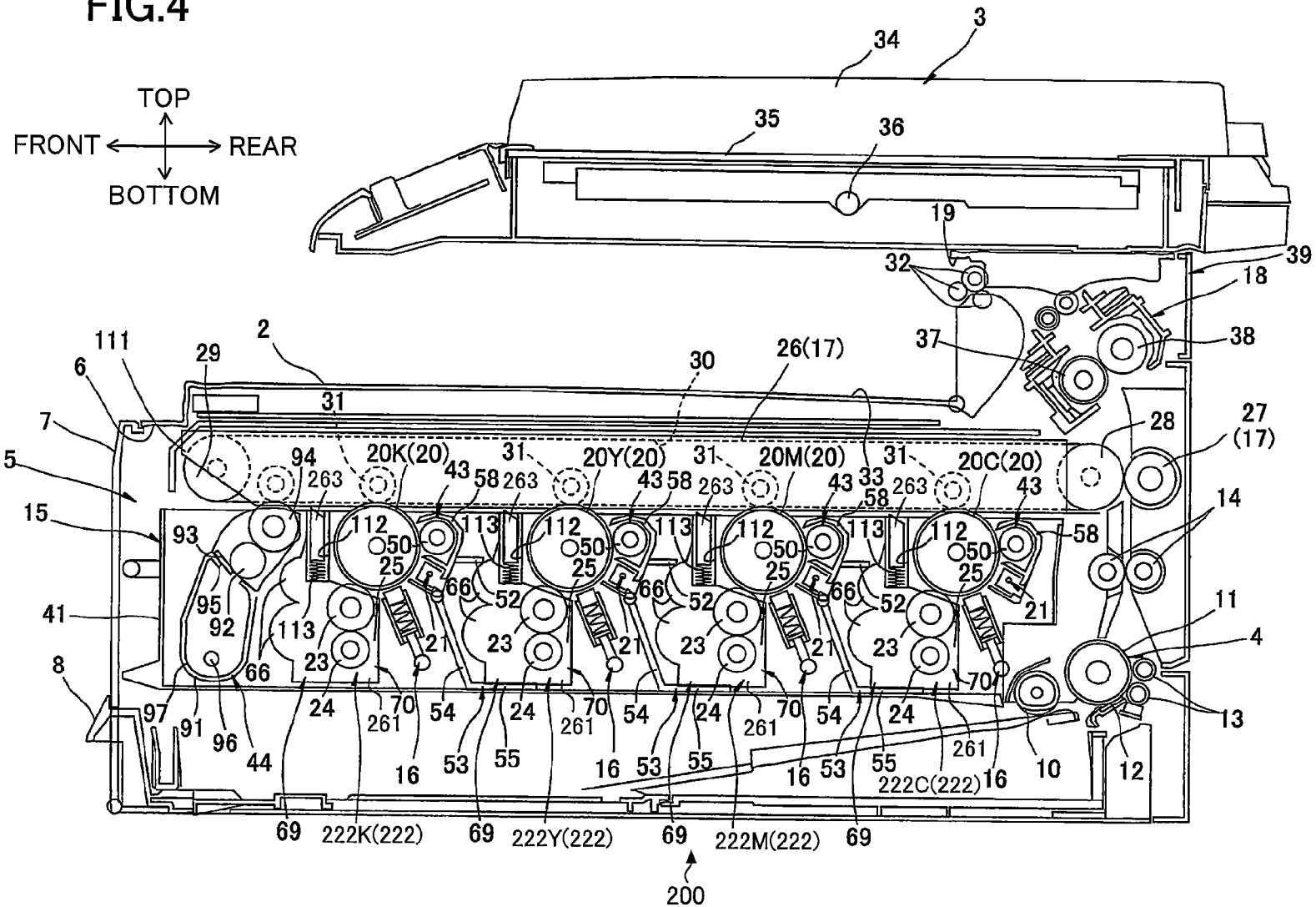
FIG. 4 is a cross-sectional view of a color printer as an image forming device according to a second embodiment of the present invention, in which a process unit is accommodated in a main casing and a handle of each developer cartridge is retracted downward.
Figure 5:
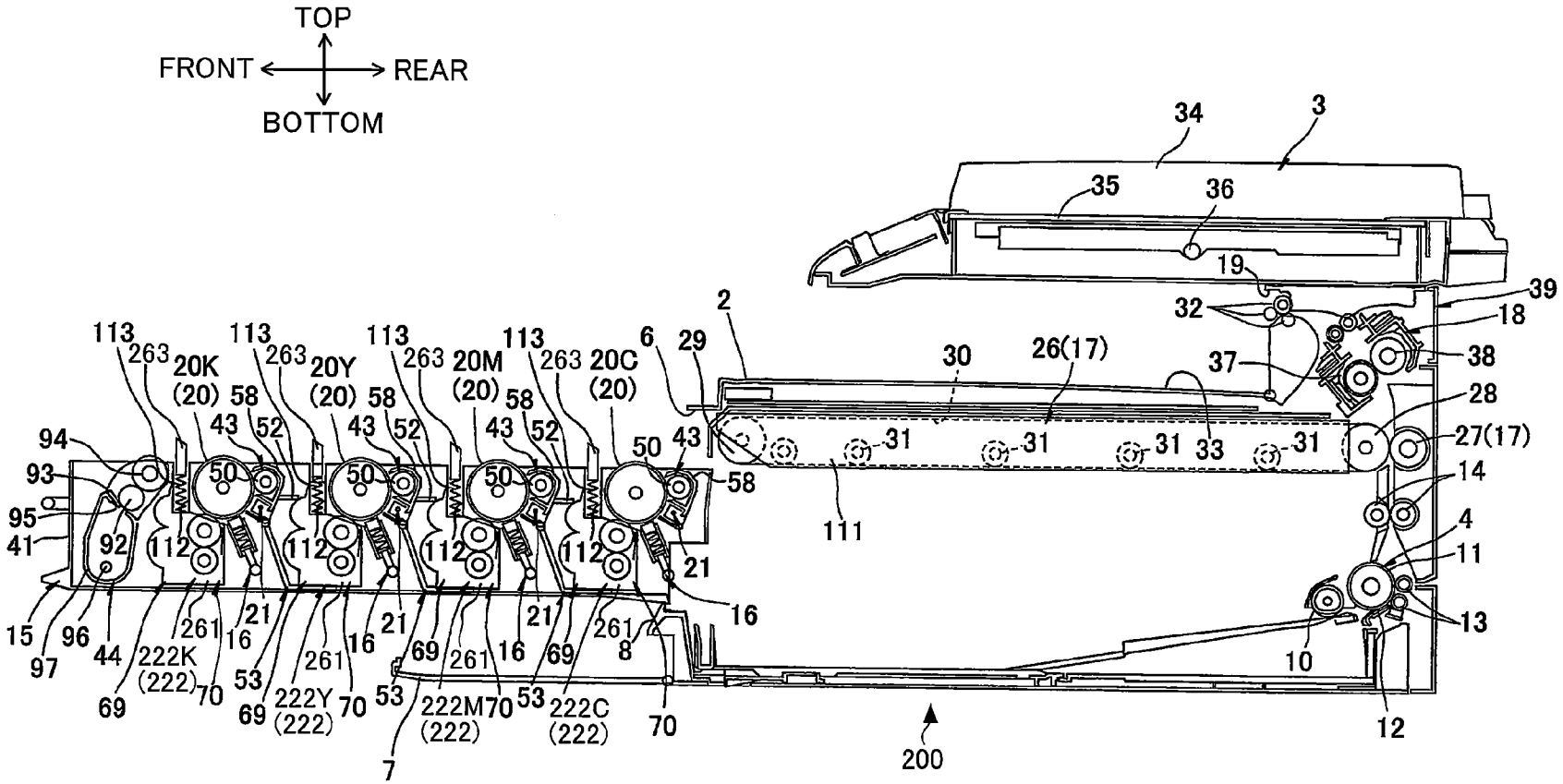
FIG. 5 is a cross-sectional view of the color printer according to the second embodiment, in which the process unit is pulled outward from the main casing and the handle of each developer cartridge protrudes upward.

As shown in FIGS. 4 and 5, a right and left pair of rail members (abutment member) 111 are provided within the main casing 2. The pair of rail members 111 is adapted to press the handle 263 downward.

Each of the rail members 111 has a generally flat plate shape that is elongated in the frontward/rearward direction. The pair of rail members 111 is arranged in confrontation with and spaced apart from each other in the rightward/leftward direction, interposing the belt unit 26 therebetween. Each rail member 111 has a top portion fixed to an upper wall of the main casing 2.

A handle accommodating portion 112 is formed in each developer cartridge 222 for accommodating the handle 263 therein. Further, each developer cartridge 222 is provided with a compression spring 113 for urging the handle 263 upward.

The handle accommodating portion 112 is defined so as to form a generally rectangular shape in a side view that is elongated in the vertical direction. The handle accommodating portion 112 is disposed at the top portion of the cartridge frame 261.

Further, the handle 263 is accommodated in the handle accommodating portion 112 and slidably movable in the vertical direction.

The compression spring 113 has one end that is fixed to a bottom wall of the handle accommodating portion 112 and another end that is fixed to a bottom end portion of the handle 263. With this configuration, the handle 263 is normally urged upward by the compression spring 113.

As shown in FIG. 4, when the process unit 15 is accommodated in the main casing 2, that is, when the process unit 15 is in the accommodated position, the top portion of each handle 263 is in abutment with a bottom portion of each of the right and left rail members 111. Hence, each of the handle 263 is depressed downward by the pair of rail members 111.

As a result, each handle 263 is accommodated in the corresponding handle accommodating portion 112 formed in the cartridge frame 261 such that the top portion of the handle 263 is retracted downward against the urging force of the corresponding compression spring 113 and positioned lower than a top edge of the photosensitive drum 20.

As shown in FIG. 5, when the process unit 15 is pulled outward from the main casing 2, that is, when the process unit 15 is in the pulled-out position, abutment of the top portion of each handle 263 with the bottom portion of each of the right and left rail members 111 is dissolved. Hence, pressure relative to each handle 263 by the pair of rail members 111 is released.

Then, each handle 263 protrudes outward from the corresponding handle accommodating portion 112 formed in the cartridge frame 261 such that the top portion of the handle 263 protrudes upward by the urging force of the corresponding compression spring 113 and is positioned higher than the top edge of the photosensitive drum 20.

In the color printer 200 according to the second embodiment, as shown in FIGS. 4 and 5, when a user pulls the process unit 15 outward from the main casing 2, and detaches and attaches the developer cartridge 222 relative to the process unit 15, the user easily holds the handle 263 protruding upward than the top edge of the photosensitive drum 20.

Consequently, detachment and attachment of the developer cartridge 222 relative to the process unit 15 can be smoothly performed.

Further, in the color printer 200 according to the second embodiment, as shown in FIGS. 4 and 5, the pair of rail members 111 is in abutment with each handle 263 from above, thereby pressing the handle 263 downward against the urging force of the compression spring 113 and accommodating the handle 263 in the handle accommodating portion 112 when the belt unit 26 (the intermediate transfer belt 30) and each photosensitive drum 20 are in the first relative positional relationship, and each handle 263 protrudes upward by the urging force of the corresponding compression spring 113 when the belt unit 26 (the intermediate transfer belt 30) and each photosensitive drum 20 are in the second relative positional relationship.

Consequently, with a simple configuration, the vertical movement of the handle 63 can be achieved in interlocking relation to the relative movement of the belt unit 26 and each photosensitive drum 20.

Further, in the color printer 200 according to the second embodiment, operations and effects similar to those of the first embodiment can also be obtained.

6. Third Embodiment

A color printer 300 as an image forming device according to a third embodiment of the present invention will be described while referring to FIG. 6.

In the following description, parts and components appearing in the third embodiment and the same as those in the first embodiment will be designated by the same reference numerals as those in the first embodiment to avoid duplicating description, and only parts and components differing from those of the first embodiment will be described.

In the above-described first embodiment, the front cover 7 is provided at the front wall of the main casing 2, and the printer 100 is configured to be a front-accessible printer capable of pulling the process unit 15 outward from the main casing 2 by opening the front cover 7.

Figure 6:
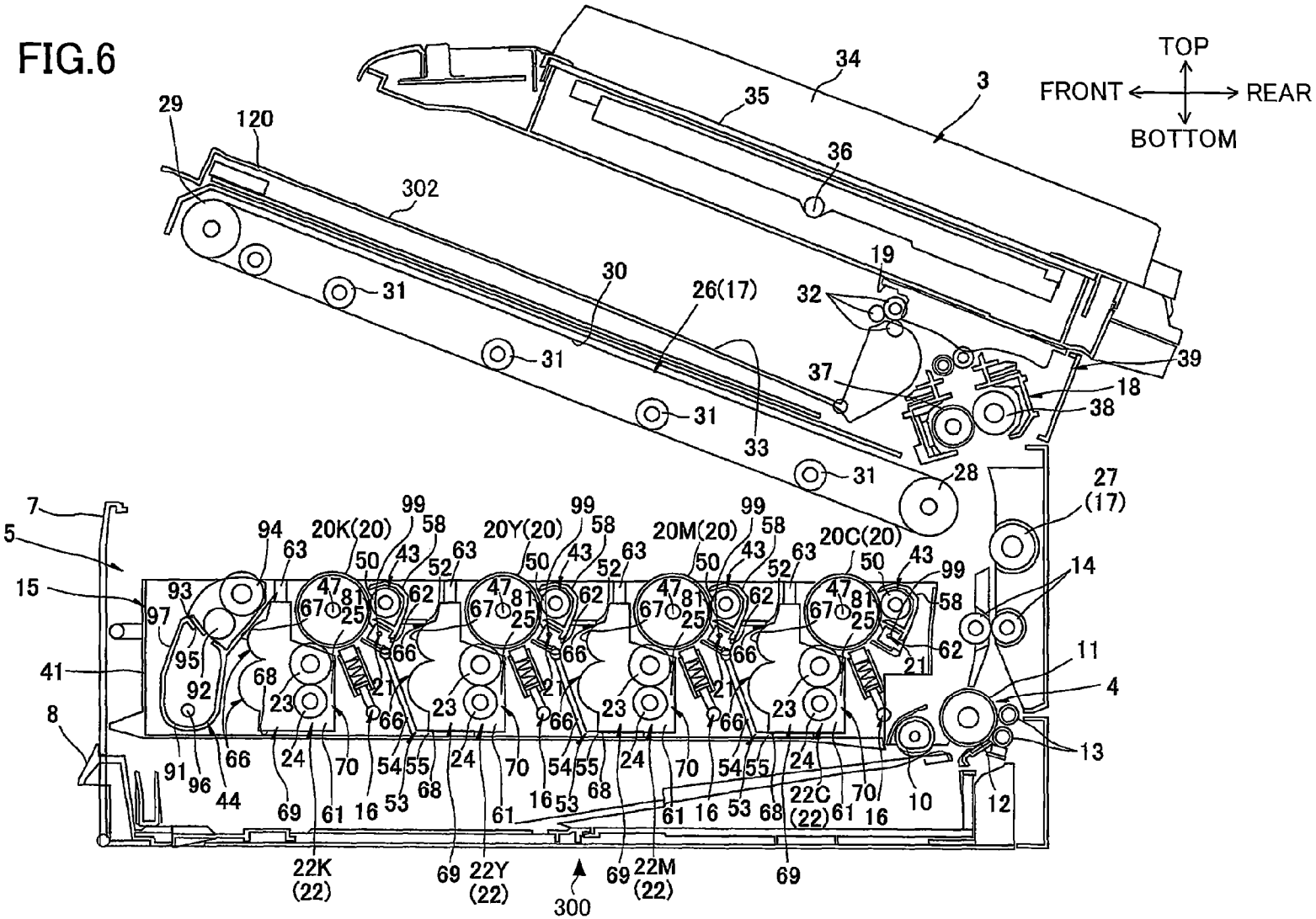
FIG. 6 is a cross-sectional view of a color printer as an image forming device according to a third embodiment of the present invention, in which a top cover is moved to an open position.

However, in the third embodiment, as shown in FIG. 6, a top cover 120 as a permitting unit is provided at a top portion of a main casing 302. The top cover 120 is movable between a closed position for providing the first relative positional relationship and an open position for providing the second relative positional relationship, and each developer cartridge 22 is attachable to and detachable from the main casing 302 (process unit 15) by opening the top cover 120.

More specifically, the top cover 120 is provided at a top wall of the main casing 302 and a top portion of a rear wall thereof.

The top cover 120 is pivotally movable about a portion of the rear wall of the main casing 302 that is disposed rearward of the fixing unit 18. The top cover 120 supports the belt unit 26 and the fixing unit 18 by means of a support mechanism (not shown).

The top cover 120 is pivotally moved to the open position integrally with the belt unit 26 and the fixing unit 18 to define an open space above the process unit 15. The top portion of the main casing 302 is entirely open when the top cover 120 is in the open position.

When the top cover 120 is opened, the belt unit 26 is moved upward and separated from each photosensitive drum 20. Therefore, the belt unit 26 (intermediate transfer belt 30) and each photosensitive drum 20 are in the second relative positional relationship. At this time, the top portion of the process unit 15 is exposed to the open space defined above the process unit 15, and the user can access each developer cartridge 22 from above.

To detach each developer cartridge 22 from the process unit 15 and to attach each developer cartridge 22 to the process unit 15, a user initially pivotally moves the top cover 120 upward to open the top portion of the main casing 302. Then, the user detaches the developer cartridge 22 from the process unit 15 (main casing 2) and attaches the developer cartridge 22 to the process unit 15 through the open space defined above the process unit 15.

In the color printer 300 according to the third embodiment, operations and effects similar to those of the first embodiment can also be obtained.

Incidentally, in the foregoing embodiments, the plurality of photosensitive drums includes four photosensitive drums, the plurality of Scorotron chargers includes four chargers, and the plurality of developer cartridges includes four developer cartridges. However, in the claimed invention, the plurality of photosensitive members implies the foremost to third photosensitive members, the plurality of chargers implies the foremost to third chargers, and the plurality of developer cartridges implies the foremost to third developer cartridges. In other words, the rearmost photosensitive member, the rearmost charger, and the rearmost developer cartridge are excluded.

While the present invention has been described in detail with reference to the present embodiments thereof, it would be apparent to those skilled in the art that various changes and modifications may be made therein without departing from the spirit of the present invention.

What is claimed is:

1. An image forming device comprising:

a main casing;

a plurality of photosensitive members disposed inside the main casing and juxtaposed with each other in a juxtaposed direction with a space between neighboring photosensitive members, each of the plurality of photosensitive members being configured to carry a developing agent image thereon;

a plurality of chargers in one-to-one correspondence with the plurality of photosensitive members and configured to charge the corresponding photosensitive members, each of the plurality of chargers being movable between a first position in which the charger is in confrontation with a corresponding photosensitive member of the plurality of photosensitive members at a first side thereof in the juxtaposed direction to charge the corresponding photosensitive member and a second position in which the charger is moved away from the first position, among the plurality of the photosensitive members and the plurality of the chargers, a first photosensitive member and a corresponding first charger comprising a first set, and a second photosensitive member and a corresponding second charger comprising a second set, the first set and the second set being arrayed with each other in the juxtaposed direction, each of the plurality of photosensitive members having a second side opposite to the first side in the juxtaposed direction;

an endless belt stretched in the juxtaposed direction and having a surface in direct confrontation with the plurality of photosensitive members at a third side thereof in an orthogonal direction generally orthogonal to the juxtaposed direction;

a plurality of developer cartridges in one-to-one correspondence with the plurality of photosensitive members, each of the plurality of developer cartridges having a portion disposed in confrontation with the corresponding photosensitive member at a fourth side thereof opposite to the third side in the orthogonal direction, each of the plurality of developer cartridges having a developing agent bearing member on which a developing agent to be supplied to the corresponding photosensitive member is carried;

a permitting unit configured to allow the plurality of photosensitive members and the endless belt to selectively establish a first relative positional relationship in which the plurality of photosensitive members and the endless belt are in contact with each other and a second relative positional relationship in which the plurality of photosensitive members and the endless belt are spaced apart from each other, each of the plurality of developer cartridges being configured to be detachably mounted in the permitting unit, a direction from the third side to the fourth side being an attachment direction of the developer cartridge into the permitting unit and a direction from the fourth side to the third side being a detachment direction of the developer cartridge from the permitting unit; and a moving unit configured to move the charger between the first position and the second position, wherein, when the permitting unit establishes the second relative positional relationship and the moving unit moves the charger of the first set to the second position, the developer cartridge for the second set is configured to be attached to and detached from the permitting unit by being moved through an open space defined between the first side of the photosensitive member of the first set and the second side of the corresponding photosensitive member of the second set, the open space being formed by the charger of the first set moving to the second position.

2. The image forming device as claimed in claim 1, wherein the moving unit comprises an interlocking unit configured to move the charger of the first set to the second position in interlocking relation to movement of the developer cartridge of the second set in the detachment direction, and to move the charger of the first set to the first position in interlocking relation to the movement of the developer cartridge of the second set in the attachment direction.

3. The image forming device as claimed in claim 2, wherein the interlocking unit comprises:

a supporting member supporting the charger and configured to be movable relative to the corresponding photosensitive member; and a contacted portion provided at one of the charger of the first set and the supporting member of the first set, the developer cartridge of the second set having a contacting portion configured to be in contact with the contacted portion when the developer cartridge of the second set is moved in one of the detachment direction and the attachment direction.

4. The image forming device as claimed in claim 3, wherein the contacted portion includes a first contacted portion and a second contacted portion; and wherein the contacting portion includes a first contacting portion configured to be in contact with the first contacted portion when the developer cartridge is moved in the detachment direction, and a second contacting portion configured to be in contact with the second contacted portion when the developer cartridge is moved in the attachment direction.

5. The image forming device as claimed in claim 4, wherein a leading photosensitive member is included in the plurality of the photosensitive members, and wherein the endless belt is configured to circularly move along an array of the plurality of photosensitive members in the juxtaposed direction and having one end portion closer to the second side than to the first side and another end portion closer to the first side than to the second side; and the image forming device further comprising a belt cleaning unit configured to clean the endless belt and disposed at the one end portion and at the second side of the leading photosensitive member that is positioned closest to the one end portion when the permitting unit establishes the first relative positional relationship, the belt cleaning unit being movable between an approaching position approaching to the second side of the leading photosensitive member and a remote position remote therefrom; and wherein the belt cleaning unit is normally in the approaching position and movable to the remote position when the permitting unit establishes the second relative positional relationship; and wherein the developer cartridge associated with the leading photosensitive member is configured to be attached to the main casing in the attachment direction and to be detached from the main casing in the detachment direction while moved past the second side of the leading photosensitive member when the permitting unit establishes the second relative positional relationship and when the belt cleaning unit is in the remote position.

6. The image forming device as claimed in claim 1, wherein the charger is disposed in confrontation with the corresponding photosensitive member at the third side when the charger is in the second position.

7. The image forming device as claimed in claim 6, further comprising a cleaning member configured to clean the charger, the cleaning member being exposed at the third side when the charger is in the second position.

8. The image forming device as claimed in claim 1, further comprising a plurality of LED units in one-to-one correspondence with the plurality of photosensitive members, each of the plurality of LED units being disposed in confrontation with the corresponding photosensitive member and configured to expose the corresponding photosensitive member to light.

9. The image forming device as claimed in claim 1, wherein the endless belt is configured to receive thereon the developing agent image carried on each of the plurality of photosensitive members.

10. The image forming device as claimed in claim 1, wherein the endless belt is configured to circularly move along an array of the plurality of photosensitive members in the juxtaposed direction and having one end portion closer to the second side than to the first side and another end portion closer to the first side than to the second side; and the image forming device further comprising a belt cleaning unit configured to clean the endless belt and disposed at the one end portion and at the second side of the photosensitive member that is positioned closest to the one end portion among the plurality of photosensitive members when the permitting unit establishes the first relative positional relationship, the cleaning unit being movable between an approaching position approaching to the second side of the photosensitive member closest to the one end portion and a remote position remote therefrom; and wherein the belt cleaning unit is normally in the approaching position and movable to the remote position when the permitting unit establishes the second relative positional relationship; and wherein the developer cartridge associated with the photosensitive member closest to the one end portion is configured to be attached to the main casing in the attachment direction and to be detached from the main casing in the detachment direction while moved past the second side of the photosensitive member closest to the one end portion when the permitting unit establishes the second relative positional relationship and when the belt cleaning unit is in the remote position.

11. The image forming device as claimed in claim 1, wherein each of the plurality of developer cartridges is provided with a holding member at the third side; and wherein the holding member is configured to be retracted in the orthogonal direction from the third side to the fourth side when the permitting unit establishes the first relative positional relationship, and is configured to protrude in the orthogonal direction from the fourth side to the third side when the permitting unit establishes the second relative positional relationship for user access to the holding member.

12. The image forming device as claimed in claim 11, wherein each of the plurality of developer cartridges is provided with an urging member configured to urge the holding member in the orthogonal direction from the fourth side to the third side; and wherein the main casing is provided with an abutment member configured to be brought into abutment with the holding member in the orthogonal direction from the third side to the fourth side to depress the holding member toward the fourth side against an urging force of the urging member when the permitting unit establishes the first relative positional relationship.

13. The image forming device as claimed in claim 1, wherein the permitting unit comprises a holder configured to hold the plurality of photosensitive members and movable relative to the main casing in the juxtaposed direction between an accommodated position in which the holder is accommodated in the main casing and a pulled-out position in which the holder is pulled outward from the main casing; and wherein the permitting unit establishes the first relative positional relationship when the holder is at the accommodated position, and establishes the second relative positional relationship when the holder is at the pulled-out position.

14. An image forming device comprising:

a main casing;

a plurality of photosensitive members disposed inside the main casing and juxtaposed with each other in a juxtaposed direction with a space between neighboring photosensitive members, each of the plurality of photosensitive members being configured to carry a developing agent image thereon;

a plurality of chargers in one-to-one correspondence with the plurality of photosensitive members and configured to charge the corresponding photosensitive members, each of the plurality of chargers being movable between a first position in which the charger is in confrontation with a corresponding photosensitive member of the plurality of photosensitive members at a first side thereof in the juxtaposed direction to charge the corresponding photosensitive member and a second position in which the charger is moved away from the first position, among the plurality of the photsensitive members and the plurality of the chargers, a first photosensitive member and a corresponding first charger comprising a first set, and a second photosensitive member and a corresponding second charger comprising a second set, the first set and the second set being arrayed with each other in the juxtaposed direction, each of the plurality of photosensitive members having a second side opposite to the first side in the juxtaposed direction;

an endless belt stretched in the juxtaposed direction and having a surface in direct confrontation with the plurality of photosensitive members at a third side thereof in an orthogonal direction generally orthogonal to the juxtaposed direction;

a plurality of developer cartridges in one-to-one correspondence with the plurality of photosensitive members, each of the plurality of developer cartridges being configured to be detachably mounted in the main casing and having a portion disposed in confrontation with the corresponding photosensitive member at a fourth side thereof opposite to the third side in the orthogonal direction, each of the plurality of developer cartridges having a developing agent bearing member on which a developing agent to be supplied to the corresponding photosensitive member is carried;

a permitting unit configured to allow the plurality of photosensitive members and the endless belt to selectively establish a first relative positional relationship in which the plurality of photosensitive members and the endless belt are in contact with each other and a second relative positional relationship in which the plurality of photosensitive members and the endless belt are spaced apart from each other to permit each of the plurality of developer cartridges to be detached from or attached to the main casing, a direction from the third side to the fourth side being an attachment direction of the developer cartridge into the main casing and a direction from the fourth side to the third side being a detachment direction of the developer cartridge from the main casing; and a moving unit configured to move the charger between the first position and the second position, wherein, when the permitting unit establishes the second relative positional relationship and the moving unit moves the charger of the first set to the second position, the developer cartridge for the second set is configured to be attached to and detached from the main casing by being moved through an open space defined between the first side of the photosensitive member of the first set and the second side of the corresponding photosensitive member of the second set, the open space being formed by the charger of the first set moving to the second position.

15. The image forming device as claimed in claim 14, wherein the permitting unit comprises a cover supporting the endless belt and pivotally movable relative to the main casing between a closed position for providing the first relative positional relationship and an open position for providing the second relative positional relationship where an open space is defined at the third side for detaching the developer cartridge from the main casing and for attaching the developer cartridge to the main casing.

16. The image forming device as claimed in claim 14, wherein the moving unit comprises an interlocking unit configured to move the charger of the first set to the second position in interlocking relation to movement of the developer cartridge of the second set in the detachment direction, and to move the charger of the first set to the first position in interlocking relation to the movement of the developer of the second set in the attachment direction.

17. The image forming device as claimed in claim 16, wherein the interlocking unit comprises:

a supporting member supporting the charger and configured to be movable relative to the corresponding photosensitive member; and a contacted portion provided at one of the charger of the first set and the supporting member of the first set, the developer cartridge of the second set having a contacting portion configured to be in contact with the contacted portion when the developer cartridge of the second set is moved in one of the detachment direction and the attachment direction.

18. The image forming device as claimed in claim 17, wherein the contacted portion includes a first contacted portion and a second contacted portion; and wherein the contacting portion includes a first contacting portion configured to be in contact with the first contacted portion when the developer cartridge is moved in the detachment direction, and a second contacting portion configured to be in contact with the second contacted portion when the developer cartridge is moved in the attachment direction.

19. The image forming device as claimed in claim 18, wherein a leading photosensitive member is included in the plurality of the photosensitive members, and wherein the endless belt is configured to circularly move along an array of the plurality of photosensitive members in the juxtaposed direction and having one end portion closer to the second side than to the first side and another end portion closer to the first side than to the second side; and the image forming device further comprising a belt cleaning unit configured to clean the endless belt and disposed at the one end portion and at the second side of the leading photosensitive member that is positioned closest to the one end portion when the permitting unit establishes the first relative positional relationship, the belt cleaning unit being movable between an approaching position approaching to the second side of the leading photosensitive member and a remote position remote therefrom; and wherein the belt cleaning unit is normally in the approaching position and movable to the remote position when the permitting unit establishes the second relative positional relationship; and wherein the developer cartridge associated with the leading photosensitive member is configured to be attached to the main casing in the attachment direction and to be detached from the main casing in the detachment direction while moved past the second side of the leading photosensitive member when the permitting unit establishes the second relative positional relationship and when the belt cleaning unit is in the remote position.

20. An image forming device comprising:

a main casing;

a plurality of photosensitive members disposed inside the main casing and juxtaposed with each other in a juxtaposed direction with a space between neighboring photosensitive members, each of the plurality of photosensitive members being configured to carry a developing agent image thereon;

a plurality of chargers in one-to-one correspondence with the plurality of photosensitive members and configured to charge the corresponding photosensitive members, each of the plurality of chargers being movable between a first position in which the charger is in confrontation with a corresponding photosensitive member of the plurality of photosensitive members at a first side thereof in the juxtaposed direction to charge the corresponding photosensitive member and a second position in which the charger is moved away from the first position, among the plurality of the photosensitive members and the plurality of the chargers, a first photosensitive member and a corresponding first charger comprising a first set, and a second photosensitive member and a corresponding second charger comprising a second set, the first set and the second set being arrayed with each other in the juxtaposed direction, each of the plurality of photosensitive members having a second side opposite to the first side in the juxtaposed direction;

an endless belt stretched in the juxtaposed direction and having a surface in direct confrontation with the plurality of photosensitive members at a third side thereof in an orthogonal direction generally orthogonal to the juxtaposed direction;

a plurality of developer cartridges in one-to-one correspondence with the plurality of photosensitive members, each of the plurality of developer cartridges having a portion disposed in confrontation with the corresponding photosensitive member at a fourth side thereof opposite to the third side in the orthogonal direction, each of the plurality of developer cartridges having a developing agent bearing member on which a developing agent to be supplied to the corresponding photosensitive member is carried, each of the plurality of developer cartridges being provided with a holding member at the third side;

a permitting unit configured to allow the plurality of photosensitive members and the endless belt to selectively establish a first relative positional relationship in which the plurality of photosensitive members and the endless belt are in contact with each other and a second relative positional relationship in which the plurality of photosensitive members and the endless belt are spaced apart from each other, the holding member being configured to be retracted in the orthogonal direction from the third side to the fourth side when the permitting unit establishes the first relative positional relationship and configured to protrude in the orthogonal direction from the fourth side to the third side when the permitting unit establishes the second relative positional relationship for user access to the holding member, each of the plurality of developer cartridges being configured to be detachably mounted in the permitting unit, a direction from the third side to the fourth side being an attachment direction of the developer cartridge into the permitting unit and a direction from the fourth side to the third side being a detachment direction of the developer cartridge from the permitting unit; and a moving unit configured to move the charger between the first position and the second position, wherein, when the permitting unit establishes the second relative positional relationship and the moving unit moves the charger of the first set to the second position, the developer cartridge for the second set is configured to be attached to and detached from the permitting unit by being moved past the second side of the corresponding photosensitive member of the second set.

21. The image forming device as claimed in claim 19, wherein each of the plurality of developer cartridges is provided with an urging member configured to urge the holding member in the orthogonal direction from the fourth side to the third side; and wherein the main casing is provided with an abutment member configured to be brought into abutment with the holding member in the orthogonal direction from the third side to the fourth side to depress the holding member toward the fourth side against an urging force of the urging member when the permitting unit establishes the first relative positional relationship.

* * * * *